US008074535B2

(12) United States Patent
Martell

(10) Patent No.: US 8,074,535 B2
(45) Date of Patent: Dec. 13, 2011

(54) DEVICE FOR TREATING BLADES TO IMPROVE THEIR CUTTING PROPERTIES

(76) Inventor: Celso E. Martell, Brossard (CA)

( * ) Notice: Subject to any disclaimer, the term of this patent is extended or adjusted under 35 U.S.C. 154(b) by 0 days.

(21) Appl. No.: 12/784,577

(22) Filed: May 21, 2010

(65) Prior Publication Data

US 2010/0223792 A1 Sep. 9, 2010

Related U.S. Application Data

(63) Continuation of application No. PCT/CA2009/000956, filed on Jul. 10, 2009.

(60) Provisional application No. 61/129,708, filed on Jul. 14, 2008.

(51) Int. Cl.
*B24D 99/00* (2010.01)

(52) U.S. Cl. ..... 76/82; 76/DIG. 9

(58) Field of Classification Search ..... 76/DIG. 9, 76/81–89.2

See application file for complete search history.

(56) References Cited

U.S. PATENT DOCUMENTS

| | | | | | |
|---|---|---|---|---|---|
| 413,540 | A | * | 10/1889 | Nichols | 76/81.5 |
| 477,902 | A | * | 6/1892 | Kampfe et al. | 76/81.5 |
| 524,828 | A | * | 8/1894 | Kampfe et al. | 76/81.5 |
| 739,534 | A | | 9/1903 | Doss | |
| 770,225 | A | * | 9/1904 | Coesir | 76/81.3 |
| 798,445 | A | * | 8/1905 | Ovenshire | 76/81 |
| 809,114 | A | * | 1/1906 | Kampfe et al. | 76/81.5 |
| 827,684 | A | * | 7/1906 | Craw | 76/81 |
| 949,585 | A | * | 2/1910 | Levalley | 76/81 |
| 950,451 | A | * | 2/1910 | Mihills | 76/81.6 |
| 986,398 | A | * | 3/1911 | Lee | 76/81.6 |
| 1,182,440 | A | | 5/1916 | Wyckoff | |
| 1,284,059 | A | | 11/1918 | Cook | |
| 1,434,949 | A | | 10/1922 | Glasner | |
| 1,540,078 | A | | 6/1925 | Long | |
| 1,558,990 | A | | 10/1925 | Leimberg | |
| 1,588,322 | A | | 6/1926 | McAdoo | |
| 1,598,147 | A | | 8/1926 | Mickelsen | |
| 1,723,124 | A | * | 8/1929 | Bencze | 76/81 |
| 371,011 | A | | 12/1930 | Morrice | |
| 1,866,384 | A | * | 7/1932 | Abranathy | 76/81 |
| 1,934,139 | A | * | 11/1933 | Pavitt | 76/81 |
| 1,955,759 | A | | 4/1934 | Murrin | |

(Continued)

FOREIGN PATENT DOCUMENTS

| | | |
|---|---|---|
| DE | 376067 | 5/1923 |

(Continued)

OTHER PUBLICATIONS

On the relation between surface texture and gloss of injection-molded pigmented Plastics http://findarticles.com/p/articles/mi_hb3367/is_10_45/ai_n29214893/.

(Continued)

*Primary Examiner* — Jason Daniel Prone
(74) *Attorney, Agent, or Firm* — Anglehart et al.

(57) ABSTRACT

A treatment device for improving the cutting properties of the blade of a non-electric shaving razor. The device has a treatment surface for interacting with the cutting edge of the razor blade, as the blade is put into sliding contact with the treatment surface. The treatment surface has a plurality of resilient honing projections that are compressed as the blade is moved in sliding contact with the surface.

39 Claims, 11 Drawing Sheets

U.S. PATENT DOCUMENTS

| | | | | | |
|---|---|---|---|---|---|
| 2,024,272 | A | | 12/1935 | Brown | |
| 2,289,062 | A | | 7/1942 | Muros | |
| 2,359,739 | A | * | 10/1944 | Schulte | 76/81 |
| 2,458,257 | A | | 1/1949 | Donovan | |
| 2,629,211 | A | * | 2/1953 | Tierney | 76/81 |
| 2,809,477 | A | * | 10/1957 | Keech | 76/81 |
| 3,099,253 | A | | 7/1963 | Taylor | |
| 3,748,790 | A | | 7/1973 | Pizzarello et al. | |
| 3,854,251 | A | | 12/1974 | Paule | |
| 3,875,702 | A | | 4/1975 | Yacos | |
| 4,120,603 | A | | 10/1978 | Downing | |
| 4,122,603 | A | | 10/1978 | Sastri | |
| 4,504,283 | A | | 3/1985 | Charvat | |
| 4,759,153 | A | * | 7/1988 | Cohen | 76/82 |
| 4,967,517 | A | | 11/1990 | Mitchell | |
| 5,036,731 | A | | 8/1991 | Fletcher | |
| 5,114,438 | A | | 5/1992 | Leatherman et al. | |
| 5,224,302 | A | | 7/1993 | Grossi | |
| 5,239,785 | A | | 8/1993 | Allen | |
| 5,785,586 | A | | 7/1998 | Delsignore | |
| 6,012,971 | A | | 1/2000 | Friel, Sr. et al. | |
| 6,062,970 | A | | 5/2000 | Back | |
| 6,506,106 | B2 | | 1/2003 | Fletcher | |
| 6,969,299 | B1 | | 11/2005 | Papetti | |
| 7,037,175 | B1 | | 5/2006 | Spiro et al. | |
| 2006/0065076 | A1 | * | 3/2006 | Friol | 76/83 |
| 2006/0084367 | A1 | | 4/2006 | Spiro et al. | |
| 2007/0074400 | A1 | | 4/2007 | Steele et al. | |
| 2009/0000426 | A1 | * | 1/2009 | Andersen et al. | 76/81 |

FOREIGN PATENT DOCUMENTS

| | | |
|---|---|---|
| GB | 332130 | 7/1930 |
| GB | 416910 | 12/1932 |
| GB | 407904 | 7/1933 |
| GB | 407904 | 3/1934 |
| GB | 932550 | 7/1963 |
| GB | 1391765 | 4/1975 |
| RU | 2297313 | 4/2007 |
| WO | 2006053189 | 5/2006 |
| WO | 2007079756 | 7/2007 |
| WO | WO 2010006422 A1 * | 1/2010 |

OTHER PUBLICATIONS

Coefficient of Friction Testing of Plastics http://www.matweb.com/reference/coefficient-of-friction.aspx.
Description of the material polyurethane (TPU http://www.google.ca/search?source=ig&hl=en&rlz=1G1GGLQENCA239 &q=Description+of+the+material+polyurethane+%28TPU%29 &btnG=Google+Search&aq=f&aqi=&aql=&oq=&gs rfai=.
Diameter of a Human Hair http://hypertextbook.com/facts/1999/BrianLey.shtml.
Double-Edged Safety Razors Ranked by Aggressiveness http://wiki.badgerandblade.com/index.php/Double-Edged Safety Razors Ranked by Aggressiveness.
Evolutions of friction Anisotropy and Heterogeneity http://fluid.ippt.gov.pl/ictam04/CD ICTAM04/SM2/11613/SM211613.pdf.
Geometry Glossary http://library.thinkquest.org/2647/geometry/glossary.htm.
Glossary of Materials Attributes http://www.grantadesign.com/resources/materials/glossary.htm.
The Physical Properties of Hair http://www.pgbeautygroomingscience.com/the-physical-properties-of-hair.html.
Surface Topography Quantification http://people.scs.carleton.ca/~michiel/MatScience.pdf.
Shave Angle Image http://wiki.badgerandblade.com/index.php/Image:SHAVE ANGLE3.jpg.
Nanomechanical Properties of Rough Surface http://www.scielo.br/scielo.php?pid=S1516-14392006000200009&script=sci arttext.
Mechanical Behaviour of Thin Metals http://www.4m-net.org/files/papers/4M2008/05-11/05-11.PDF.
Behaviour of Very Thin Metals http://www.em.tue.nl/pdfs/2004janssen.pdf.
Martensitic Transformation Under Stress http://hal.archives-ouvertes.fr/docs/00/25/41/78/PDF/ajp-jp4199606C146.pdf.
Optical Measurements of Sharpness http://www.veeco.com/pdfs/appnotes/AN538 Blades%20 Sharps 120.pdf.
Sharpening Techniques http://www.extremely-sharp.com/direct/sharpknife.html.
Razor Sharpening http://www.knifecenter.com/knifecenter/sharpen/instrazor.html.
Interacting Surfaces http://arjournals.annualreviews.org/doi/abs/10.1146/annurev.ms.04.080174.001253?journalCode=matsci.1.
Human Hair Thickness http://hypertextbook.com/facts/1999/BrianLey.shtml.
F Marketz et al 1994 Modelling Simul. Mater. Sci. Eng. 2 1017-1046, "Micromechanical modelling of stress-assisted martensitic transformation".
Razor Sharpening and Using Tips.
Razor Sharp Idea, Montreal Gazette, Aug. 8, 2008.
TinSil 70 Series, High-Performance, Flexible, RTV Silicone Rubbers, Polytek, Development Corp.
ERICS Sealing elements, Teflex-VMQ Silicone—technical Data Sheet, Jan. 4, 2004.
Hair Analysis, David A. Katz.
Prediction of asperity contact condition using FFT-based analysis for micro-grooved surface design in tribological applications.
International Preliminary Report on Patentability.

* cited by examiner

DEVICE FOR TREATING BLADES TO IMPROVE THEIR CUTTING PROPERTIES

This application is a continuation of PCT/CA2009/000956 filed 10 Jul. 2009, which is a nonprovisional of U.S. provisional patent application 61/129,708 filed Jul. 14, 2008, the specification of which is hereby incorporated by reference.

FIELD OF THE INVENTION

The present invention relates to non-electric shaving razors, and more particularly a device for treating the blades of such shaving razors.

BACKGROUND OF THE INVENTION

There are known devices for sharpening the blades of non-electric shaving razors (such as permanent or disposable manual safety razors) in order to improve their cutting properties and so prolong their operational lifespan. Certain of these devices use sophisticated mechanical or electronic components and mechanisms that abrade a razor blade (or blades) in order to make it sharp again. Typical examples of such devices are shown in U.S. Pat. Nos. 1,540,078, 1,588,322, 2,289,062, 2,458,257, 3,854,251, 3,875,702, 5,036,731, 5,224,302, 6,062,970, 6,506,106, and 6,969,299, as well as in PCT Patent Publication WO 2006/053189-A1 and British Patent Publication No. GB-332130.

These devices overlook the particular characteristics and mechanical properties of a razor blade (such as its ductility and malleability), as well as plastic deformation(s) that can occur along the limits of the cutting edges of these blades (i.e., in an area typically within three (3) microns of the blade's cutting edge). In particular, the round-shaped rims of the microscopic cutting edges that perform the cutting action define radii of no more than 0.00005 mm (0.000002"). However, these micro-fine edges are, in fact, considerably smaller than the average size of the abrading grit considered or used by many known sharpening devices, namely an average size of about one (1) micron, or approximately 0.001 mm (0.00005"). Accordingly, abrasive grit is not well suited to bring a dulled blade back to its original condition due to its grain size as the destructive abrading action between the blade and the grit may create micro-indentations along the cutting edge of a razor blade that promotes plastic flow toward the hidden side of the edges, and which consequently compromises the shaving comfort of a user.

Therefore, it would be desirable to provide a device for use on non-electric shaving razors for treating the blades of these razors in order to improve their cutting properties.

SUMMARY OF THE INVENTION

As embodied and broadly described herein, the invention provides a treatment device for improving the cutting properties of the blade of a non-electric razor. The device has a treatment surface for interacting with the cutting edge of the razor blade, as the blade is put into sliding contact with the treatment surface. The treatment surface has a plurality of resilient honing projections. Optionally, the treatment surface includes an extension that is flat and glossy.

Another aspect of the invention described here also provides a method for treating a blade of a non-electric shaving razor to improve its cutting properties. The method includes providing a treatment surface including a plurality of resilient projections and moving the blade and the treatment surface one relative to the other in a sliding contact such that the cutting edge of the blade is in a sliding contact with the resilient projections. During the sliding contact the manual razor is pressed against the treatment surface such that the cutting edge compresses the projections.

BRIEF DESCRIPTION OF THE DRAWINGS

A detailed description of examples of implementation of the present invention is provided hereinbelow with reference to the following drawings, in which.

Figure 1:
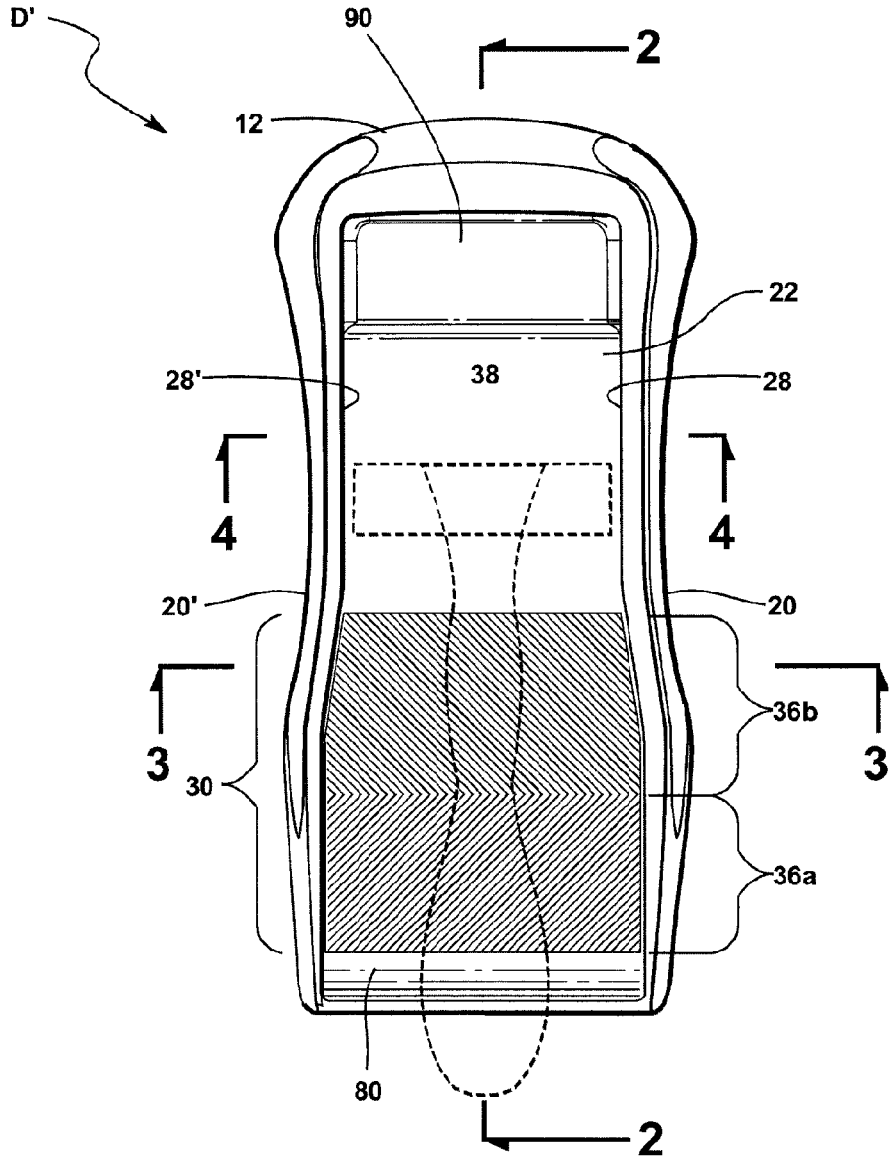
FIG. 1 is a top plan view of a razor blade treatment device that is in accordance with a non-limiting example of implementation of the invention.

In the drawings, embodiments of the invention are illustrated by way of example. It is to be expressly understood that the description and drawings are only for purposes of illustration and as an aid to understanding, and are not intended to be a definition of the limits of the invention.

DETAILED DESCRIPTION

In accordance with the present invention and with reference to the appended drawings, a device is presented for treating the cutting blades of non-electric shaving razors, such as permanent manual safety razors and/or disposable manual safety razors, and which may collectively be referred to as "manual razors" hereafter. In particular, the device presented through an illustrative embodiment of the present invention provides a device for restoring the cutting blades of manual razors, regardless of the number of blades that such razors may be equipped with. An example of the usage of the device described here will also be presented to illustrate how this device may be used to restore the blades of a manual razor.

FIG. 1 shows a razor blade treatment/restoration device D' that is enclosed within a case, which may include a lower section 12 and an optional upper section (not shown). The lower section 12 is comprised of a bottom wall 18 and a peripheral rim 20 and 20' extending vertically therefrom that defines an open-ended cavity 22 into which the features of this device are located. In a non-limiting example of implementation, the device D' that is enclosed in the lower section 12 is affixed to the bottom wall 18 and peripheral rim 20 in a permanent manner.

If the case includes the optional upper section, this section may be pivotally mounted to the lower section 12 using a hinge or similar hinged fastener along a common side.

The treatment device D' has a plate-like central recess 24 for receiving the blade(s) of a manual razor. This central recess is long enough to allow the manual razor head containing the blades to be moved along it in a forward motion hereafter referred to as a "restoration stroke" or "treatment stroke", which are synonymous terms for this action. As a result, the length and width of the central recess 24 are dimensioned in relation to accommodate such strokes from a manual razor.

The length of a restoration stroke applied on the surface of the treatment device D' could be several times the height of a blade within the manual razor head, although this length may vary depending on the dimensions of the head. In particular, the length of the central recess 24 is likely to be at least twice (i.e., two (2} times) the height of a blade within the manual razor head to allow a restoration stroke to be performed by a user. In addition, the width of this recess is also dimensioned to accommodate the width of the head of the manual razor, and is typically slightly wider to allow the razor head (and its encased blades) to slide along this area during the performance of a treatment stroke.

In a specific and non-limiting example of implementation, the length of the central recess 24 is about 4 inches and the general width of the central recess 24 is from about 2⅛ inches to about 1⅛ inches to accommodate a typical restoration stroke. However, these dimensions may vary without departing from the spirit of the invention.

In addition, the central recess 24 of the razor blade restoration device D' is bounded by an interior peripheral rim 28 and 28'. The walls of the peripheral rim 28 and 28' generally serve to orient the razor head, and more particularly the encased razor blades in the head, during use of the device D'. The placement of the rim 28 and 28' may help prevent the manual razor head from inadvertently breaking sliding contact with or otherwise leaving the central recess 24 while a restoration stroke is being performed. Furthermore, the distance between the opposed walls of the interior peripheral rim 28 and 28' may be reduced at certain points along the length of the central recess 24 such that the general orientation of the razor head becomes somewhat more constrained at the conclusion of a restoration stroke.

Through these components, the central area of the razor head (i.e., the portion of the head that encases the blades and is typically in physical contact with a person's skin during a shaving stroke) may be placed into, and remain in sliding contact with, the restoration surface of the device D' located within the central recess 24.

Material of the Treatment/Restoration Device D'

Figure 2:
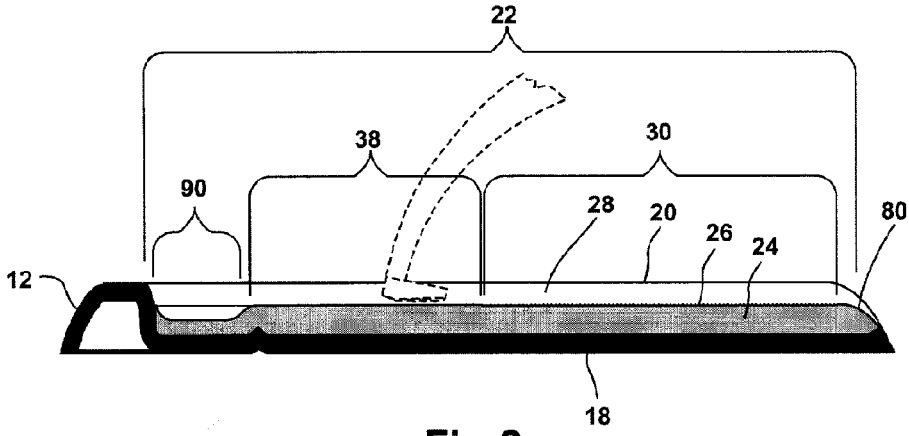
FIG. 2 is a cross-section view along lines 2-2 in FIG. 1.

FIG. 2 shows a cross-section of the treatment/restoration device D' that illustrates how certain interior portions of this device, such as the plate-like central recess 24 and a surface 26 upon which restoration strokes are performed, are made from a "resilient material". As used here, the term "resilient material" refers to the ability of such a material to readily deform upon the application of pressure, as well as its ability to generally spring back to its original shape when such pressure is removed.

In contrast, certain non-interior portions of the treatment device D' (such as the bottom wall 18 and the peripheral rim 20 and 20') are made from a non-resilient material that may be different than the resilient material. Areas where the two types of materials meet may be joined using methods known in the art, such as overmolding or the use of chemical or mechanical bonds (e.g., fastening using a glue or epoxy), so that the device D' appears as a single unit.

In general, the resiliency of a prospective resilient material can be tested using a device such as a Shore Durometer and the results compared with a scale corresponding to the ASTM D2240 standard, which shows its relative hardness or resiliency. A Shore Durometer provides a dimensionless value ranging from 0 to 100 that is based on the penetration depth of a conical indentor in the material being tested. Higher Durometer results generally indicate decreasing resiliency and increasing hardness for a material when compared against one of the Shore scales provided by the ASTM D2240 standard, such as the Shore A or Shore 00 scales.

In accordance with a non-limiting example of implementation of the invention, certain polymeric materials may be considered as resilient materials for the treatment device D'. In a first non-limiting example, a material such as an elastomer (i.e., a class of materials that include a variety of elastic hydrocarbon polymers, such as natural or artificial rubber) can be used to create the treatment device D'. In a second non-limiting example, a similar synthetic or thermoplastic rubber such as Acrylic rubber, Butadine rubber, Butyl rubber, Isoprene rubber, Nitrile rubber, Polysulfide rubber, Silicone rubber, Styrene Butadine rubber and/or thermoplastic elastomeric rubber could be used to create the treatment device D'. Other resilient materials with similar elastomeric properties that could be used to create the treatment device D' include Cholorsulfonated Polyethlene (also known as Hypalon), Ethlene Propylene Diene Monomer, Fluoroelastomers (also known as Viton), Perfluoroelastomer and/or Polychloroprene (also known as Neoprene) among others, as well as any other man-made material.

Those skilled in the art will realize that the materials listed above that could be considered resilient materials comprise a non-exhaustive list, as other materials exist and which would fall within the scope of the invention.

In particular, the Shore value indicating the resiliency of the resilient material used for the certain interior portions of the treatment device D' when measured using a Shore Durometer and the Shore A or 00 scale in the ASTM D2240 standard may be generally a value less than 70, more specifically a value less than 50, and yet more specifically a value less than 30. The values listed above should not be considered as factors limiting the scope of the invention, however.

FIG. 2 shows that the restoration surface 26 lies generally parallel with the bottom wall 18 of the lower section 12. Although the structure of this component is discussed in more detail below, the surface 26 includes a first section 30 containing a plurality of resilient honing action projections 55 (hereafter referred to as "honing projections"), as well as a second section 38 that does not contain these projections.

Typically, the restoration device D' may be formed entirely from one of the resilient material(s) mentioned previously, such as a natural or man-made rubber. Alternatively, only the surface 26 (or some part thereof, such as the first section 30) may be comprised of the resilient material (e.g., thermoplastic elastomeric rubber), while the remainder of the device D' may be comprised of a different material, such as a different type of rubber or another elastomer (e.g., Neoprene). For example, the surface 26 may be formed from the resilient material as a first piece, which is then attached to a base piece that is made of a material much more rigid than the first piece.

In another alternative embodiment, only the honing projections 55 in the first section 30 may be made from the resilient material (e.g., thermoplastic elastomeric rubber), while the rest of the surface 26 and/or device D' is made of a different material. For example, the honing projections 55 may be individually formed from the resilient material, which are then deposited upon and attached to the surface 26 that is made of a different material (e.g., rigid plastic) through certain physical or chemical means implemented during the manufacture of the device D' and which is known in the art.

Surface Structure

Figure 3:
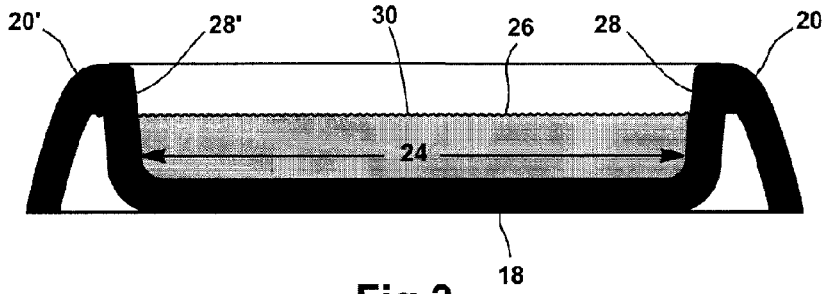
FIG. 3 is a cross-section view along lines 3-3 in FIG. 1.
Figure 4:
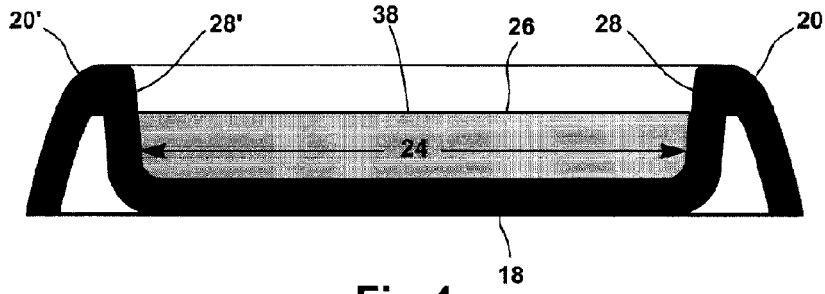
FIG. 4 is a cross-section view along lines 4-4 in FIG. 1.
Figure 5:
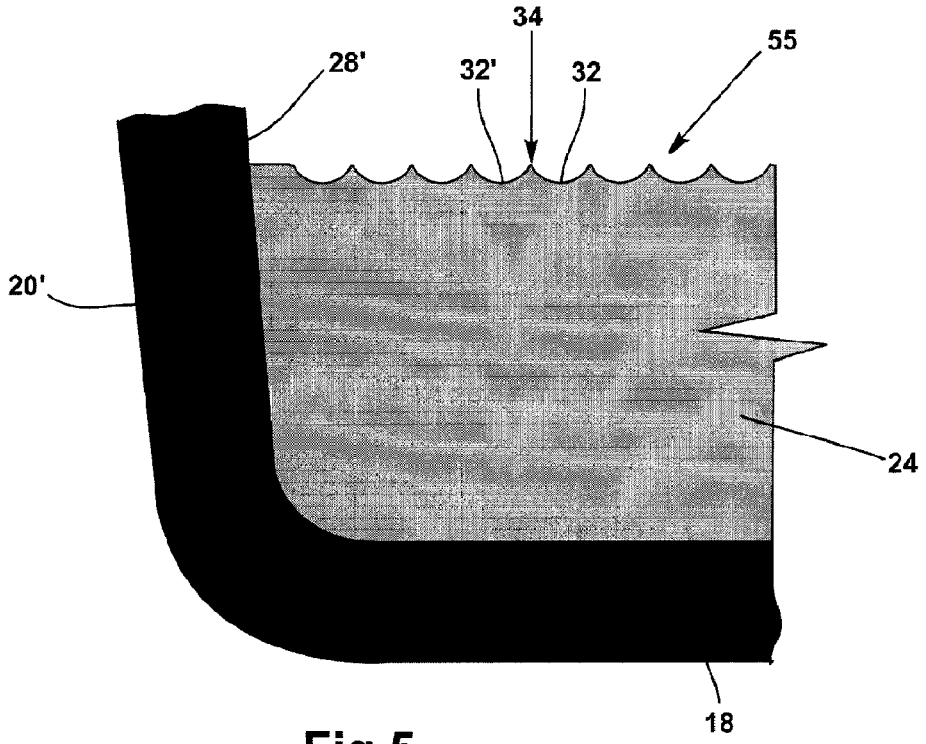
FIG. 5 is a fragmentary enlarged cross-section view of the razor blade treatment device in FIG. 3, illustrating the structure of honing projections located on the razor blade treatment surface.
Figure 6:
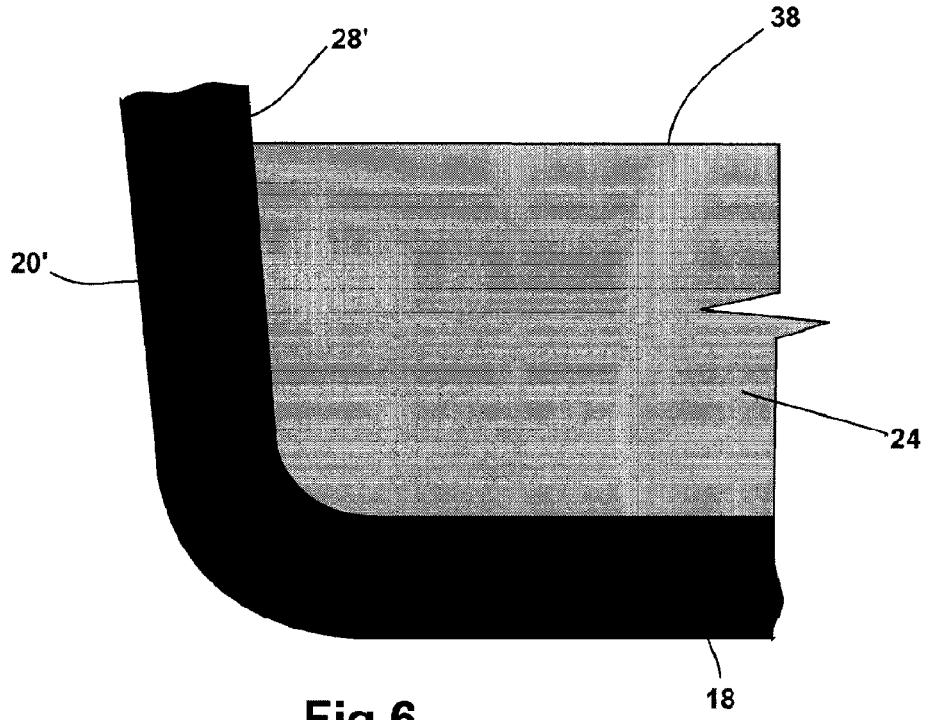
FIG. 6 is an enlarged cross-section view of the razor treatment device in FIG. 4, illustrating the structure of a stropping pad on the razor blade treatment surface.

The surface 26 of the restoration device D' is comprised of the first section 30 and the second section 38, which may be generally adjacent to each other. In particular, the surface 26 typically includes:

1. a first honing section 30 that contains a plurality of the honing projections 55, cross-sections of which are illustrated in FIGS. 3 and 5, respectively; and
2. a second section 38 that defines a stropping pad or surface, cross-sections of which are illustrated in FIGS. 4 and 6, respectively. The second section is generally adjacent to the first section 30, but is substantially flat and smooth and does not contain the honing projections 55.

This arrangement of the sections 30 and 38 allow the razor head (and in particular, the encased blades within the razor head) to first sweep the honing projections 55 contained within the first section 30, which hones the razor blades, and then subsequently sweep the complementary flat and smooth surface of the stropping pad within the second section 38 that in turn strops the razor blades during a restoration stroke.

During the first part of the restoration stroke, the razor blade(s) sweeps the honing projections 55, which provide a discontinuous contact surface with the blade edge. As can be seen from FIG. 1, the honing projections 55 may comprise of a set of projections wherein each resilient projection within the set has a generally linear configuration. Such a linear configuration typically results in each projection of the honing projections 55 including at least one segment that is in the form of a straight line or a curve.

The discontinuous contact surface provided by the honing projections 55 is characterized by a "density" of honing projections that generally refers to the number of honing projections that can make physical contact mainly with the beveled segment of the blades that are adjacent to the cutting edge of each razor blade. In a non-limiting example, the cutting edge of each blade makes contact with between one (1) and five (5) honing projections per lineal millimeter of blade edge, more particularly with between two (2) and four (4) honing projections per lineal millimeter, and even more specifically makes contact with three (3) honing projections per lineal millimeter, when measured along a cross-section of the area of the first section 30.

FIG. 5 shows that each resilient projection within the honing projections 55 is comprised of a base portion 32 and a tip portion 34. For simplicity, these components will be respectively referred to as simply "the base" and "the tip" hereafter. The tip 34 of each honing projection is at the same height as the flat and smooth surface of the second section 38 (shown in FIG. 6) in order that the two components of the surface 26 may be level with each other. Thus, a razor blade moving along the surface 26 during a restoration stroke can pass from the first section 30 to the second section 38 in a flat transition to avoid any wrapping effect being applied to the cutting lines of the blades.

In contrast, the base 32 of each resilient projection within the honing projections 55 lies at a depth which is below that of the surface 26. The difference between the tip 34 (which lies flush with the surface 26) and the base 32 (which lies below the surface 26) defines the height (or depth) of a projection. Typically, the height (or depth) of the honing projections 55 may be generally less than 1.0 mm high, more specifically less than 0.7 mm high, even more specifically less than 0.5 mm high, yet more specifically 0.3 mm high and as yet more specifically less than 0.2 mm high.

In addition, the depth between the base 32 or 32' and the tip 34 allows a small amount of shaving cream or other lubrication to collect between adjacent resilient projections at a level generally below that of the surface 26. When a razor blade passes over the honing projections 55 during a treatment stroke, the slight pressure resulting from the sliding contact between the blade and adjacent resilient projections may cause some of the lubricant to be forced up from the base 32 and 32' to the tip 34, thus lubricating the resilient projection for subsequent restoration strokes.

The shape of the resilient material between the base 32 and the tip 34 determines the general cross-sectional shape of the resilient projections within the honing projections 55, which in this case are shaped as generally risen extensions with concave sides. Those skilled in the art will appreciate that other types of cross-sectional shapes for these projections are possible, such as semi-sinusoidal, triangular and/or laminar shapes, among others.

In contrast, the shape of the honing projections 55 themselves along the first section 30 may include segments that are generally linear (i.e., follow a straight line), curved (i.e., follow an arc or wave) and may also include discrete lands and/or interspersed sections. Certain of these are described in more detail below.

3. Straight Lines

The honing projections 55 may be linear and include segments that follow substantially straight lines. In such a case, linear honing projections may have the same orientation along their entire length, or experience changes in their orientation at certain points. For example, FIG. 1 shows an instance of the honing projections 55 organized within a first section 36*a* and a second section 36*b*, wherein each resilient projection within these sections follows the same 45° orientation along their length. As a result, a right angle is formed where the resilient projections of the first section 36*a* meet the resilient projections of the second section 36*b*, which results in the honing projections 55 generating a distinctive chevron-like pattern in the first section 30.

Figure 7:
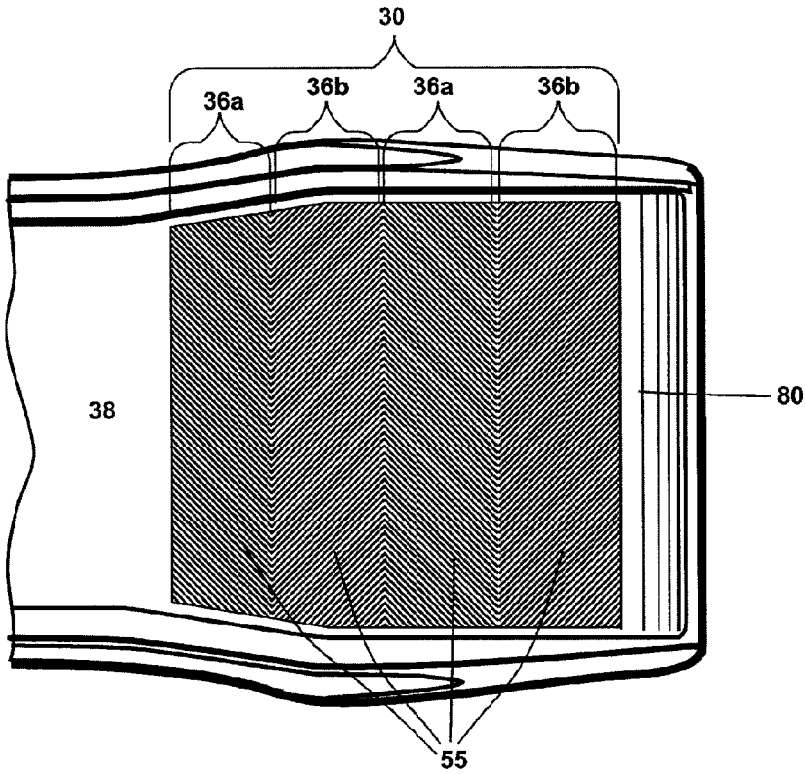
FIG. 7 is a top plan view of a first variant of the device illustrated in FIG. 1 with honing projections that follow substantially straight lines.

FIG. 7 shows a similar embodiment, where the first section 30 includes multiple instances of the first and second sections 36*a* and 36*b*. Because the 45° orientation of the honing projections 55 changes several times at certain common inflection points, the honing projections generate a pattern with multiple chevrons along the first section 30 of the surface 26.

Figure 11:
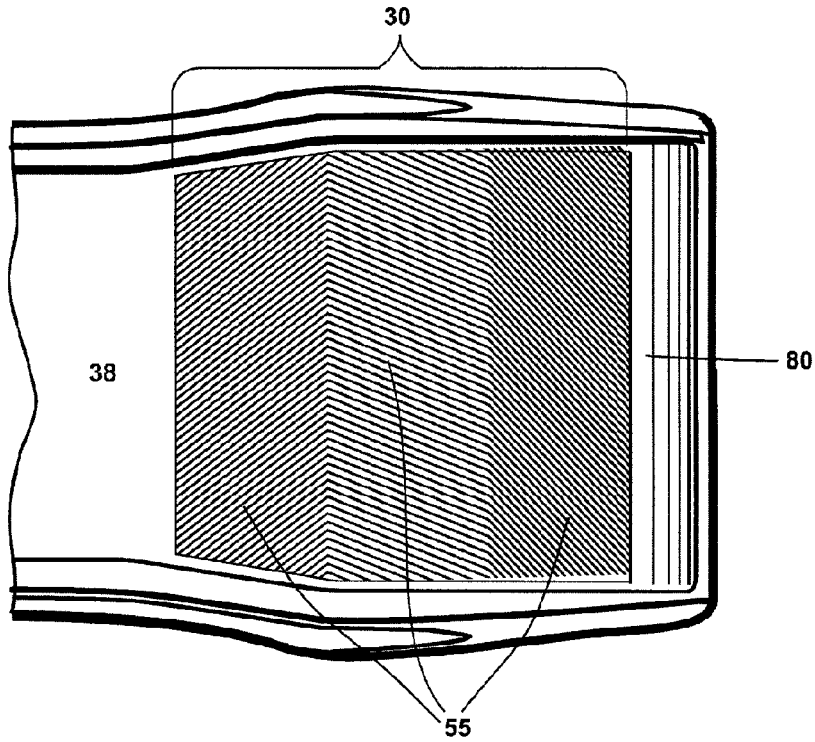
FIG. 11 is a top plan view of an fifth variant of the device illustrated in FIG. 1 with honing projections that vary in orientation.

In contrast, FIG. 11 shows an alternative embodiment whereby the orientation of the honing projections 55 includes straight-line segments set at a variety of angles. Although the honing projections 55 in this embodiment do include straight-line segments, their orientation is likely at angles other than 45° and the distinctive chevron pattern seen in FIGS. 1 and 7 is absent.

In addition, it may be possible for certain projections that include segments with substantially straight lines in the honing projections 55 to intersect other projections with segments that are not straight, such as projections with segments that follow curved lines, which are discussed below.

2. Curved Lines

The honing projections 55 may also include linear projections that include segments that follow generally curved lines. The term "generally curved" refers to a certain segment or portion of the projection that follows an arc. Like linear honing projections, projections that follow curved lines may follow substantially the same arc or experience changes in their orientation at certain inflection points.

Figure 8:
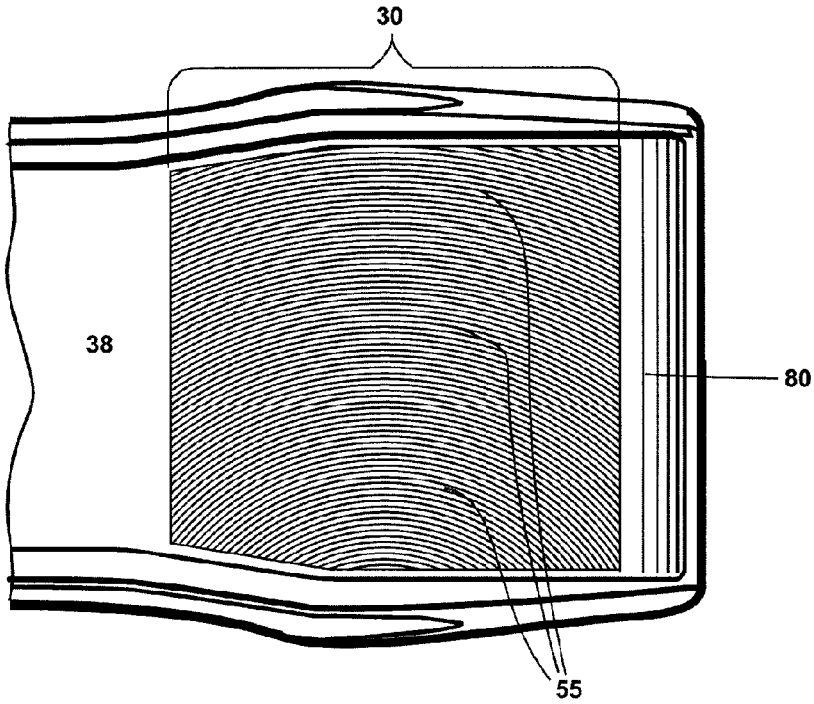
FIG. 8 is a top plan view of a second variant of the device illustrated in FIG. 1 with honing projections that follow generally curved lines.
Figure 9:
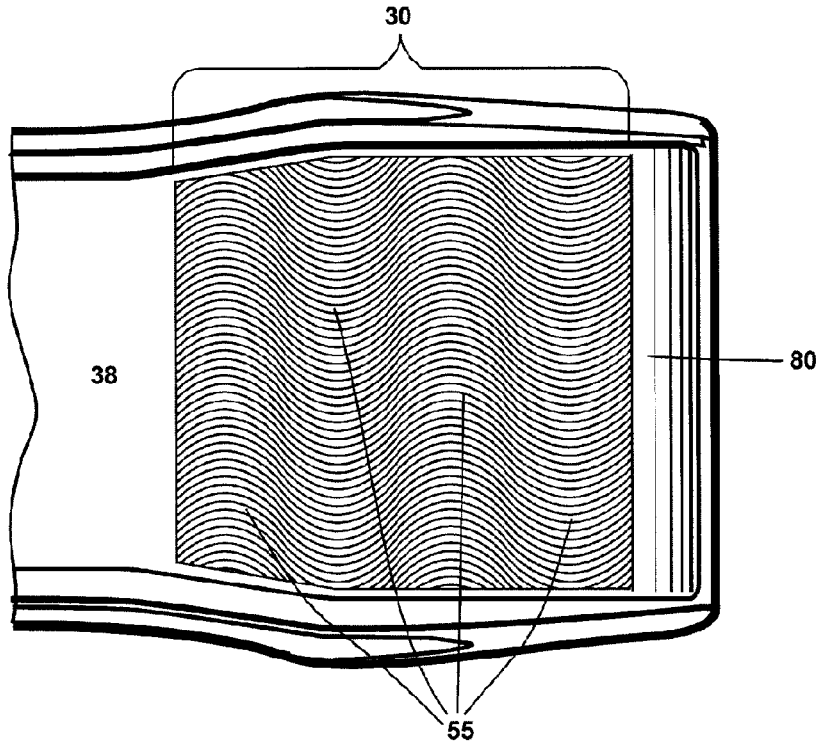
FIG. 9 is a top plan view of a third variant of the device illustrated in FIG. 1 with honing projections that follow generally curved lines whose orientation changes at certain points along the razor blade treatment surface.

For example, FIG. 8 shows an instance of the honing projections 55 organized within a first section 36*a* and a second section 36*b*, where each projection within these sections follows the same general orientation. In contrast, FIG. 9 shows an instance of the honing projections 55 whereby the arc of each projection changes at certain common inflection points, resulting in a wave-like pattern being formed across the first section 30 of the surface 26. In addition, it may be possible for certain projections that include segments that follow curved lines in the honing projections 55 to meet or intersect other projections that include segments that follow curved or straight lines.

3. Discrete Lands

In addition, the honing projections 55 may also be comprised in discrete lands. In this case, the projections may be organized in the form of circles, triangles, squares, rectangles, hexagons or other polygonal shapes.

4. Interspersed Sections

Alternatively, the sections 30 and 38 may be merged by interspersing areas containing the honing projections 55 with other areas that are flat and free of these projections. In a specific arrangement, the instances of the first section 30 containing the honing projections 55 may be alternated with instances of the second section 38 that are free of these projections.

Arrangement of Honing Projections

The honing projections 55 in the treatment/restoration device D' may be organized within the first section 30 of the surface 26 in a variety of different arrangements, including uniform and non-uniform distribution of projections and/or an arrangement of projections that are structured within individual 'islands' that are adjacent to, or alternate with, these projections.

Regardless of the type of arrangement used or organize the honing projections 55, segments within each projection of the honing projections 55 extend somewhat obliquely in relation to the direction of movement of each razor blade along the surface 26 such that the movement of the blade along the honing projections 55 will bring the entirety of the cutting surface of the blade into sliding contact with the projections 55.

To illustrate this, consider a non-limiting example whereby the honing projections 55 contains a single resilient projection and the razor contains a single blade. Assume that the honing projections 55 are arranged in the chevron pattern shown in FIG. 1, whereby a certain portion of each resilient projection is oriented at a 45° angle relative to the general direction of travel of the razor. When the razor blade initially encounters the resilient projection, two points of contact occur where the blade and projection meet, namely at the extremity of the projection closest to the walls of the peripheral rim 28 and 28'.

As the razor is driven forward, the arrangement of the honing projections, and in particular, the somewhat oblique angle at which this projections are oriented to the razor's direction of travel, causes the contact points between the razor blade and the resilient projection to travel towards each other along the blade's edge. In particular, the 45° orientation of the resilient projection causes each contact point between the blade and the projection to travel from its respective extremities towards the center of the projection, meeting at the center of the projection, which likely corresponds to the central area of the blade. Thus, the entirety of the cutting surface of the razor blade is brought into sliding contact with the projection.

Those skilled in the art will appreciate that the movement of the contact point along the cutting edge of a razor blade described above is similar to the action that occurs during a pass of a sharpening steel or honing rod against the edge of a knife. Moreover, the density of the honing projections 55 within the first section 30 ensure that such a honing actions is applied multiple times to the cutting edge as the blade passes along this area. For example, an embodiment of the invention as described above, with a density of three (3) honing projections per lineal millimetre (as measured along a cross-section of the first section 30) could potentially deliver approximately 100 such honing passes to the cutting edge of a razor blade.

FIG. 1 shows a non-limiting example of a uniform arrangement of the honing projections 55. As used here, the term "uniform arrangement" refers to the organization of the projections 55 in a similar fashion throughout the first section 30. With respect to this figure, it may be seen that the uniform arrangement of the honing projections 55 shown include the first and second portions 36*a* and 36*b*. Within each of these sections, the honing projections 55 extend substantially parallel with each other, and the resilient projections 55 within the first section 36*a* extend at a constant angle with respect to the resilient projections within the second section 36*b*.

Figure 10:
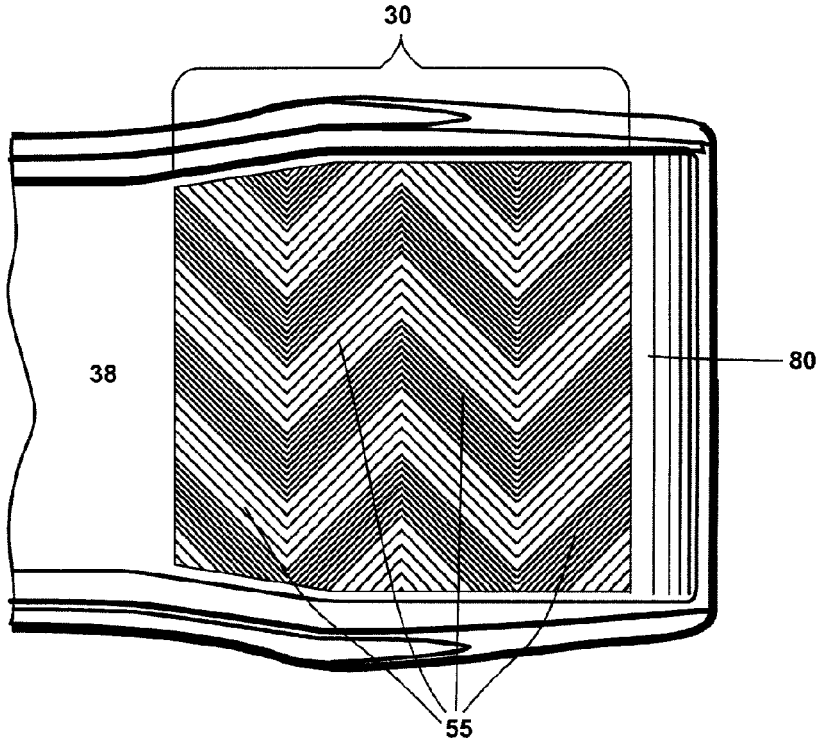
FIG. 10 is a top plan view of a fourth variant of the device illustrated in FIG. 1 with honing projections that vary in density.

Alternatively, FIG. 10 shows an arrangement of the honing projections 55 with a variable (i.e., nonuniform) density. In a first non-limiting example, certain resilient projections are spaced farther apart from each other, although all of the honing projections 55 continue to remain generally parallel with each other. With reference to this figure, the honing projections 55 are organized into groups where the individual resilient projections within each group are deliberately spaced closer to or farther apart from each other.

Figure 12:
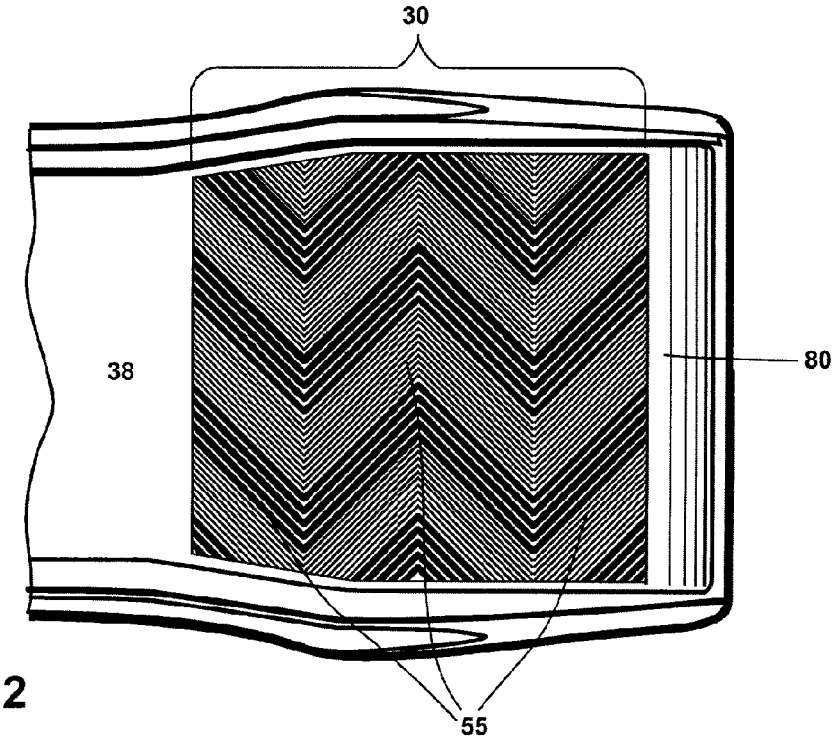
FIG. 12 is a top plan view of a sixth variant of the device illustrated in FIG. 1 with honing projections that vary in width.

FIG. 12 shows a second non-limiting example, wherein the thickness (as defined by the vertical distance between the base 32 and the tip 34) of the honing projections 55 varies. With reference to this figure, certain resilient projections within the honing projections 55 are thicker (or thinner) than other projections, so as to create some variance in the amount of honing applied to the razor blade. It will be understood that that varying the thickness of the resilient projections within the honing projections 55 may be done concurrently with varying the spacing and/or the angle of orientation between segments within the resilient projections discussed previously.

In an alternative embodiment, the honing projections 55 may be organized in a non-uniform arrangement along the first section 30 of the surface 26. EExamples of such non-uniform arrangements may include groups of resilient projections that are organized to produce a particular shape or a particular spatial relationship.

In a non-limiting example, the honing projections 55 having a linear extent may be organized into separate 'islands' that are integrally formed with the flat and smooth surface of the second section 38 in order to form particular shapes, such as circles, honeycombs (i.e., hexagons) or other irregular shapes, such as those representing alphanumeric text, symbols or a graphic (e.g., an arrow or a corporate logo). In this example, aspects of the sections 30 and 38 of the surface 26 may be intermixed, such that each island of resilient projections contains and/or is bounded by areas or portions of the stropping pad or surface. As before, this configuration allows only the tip 34 of each of the honing projections 55 to come into contact with the cutting edge of a razor blade during a treatment stroke.

Figure 13:
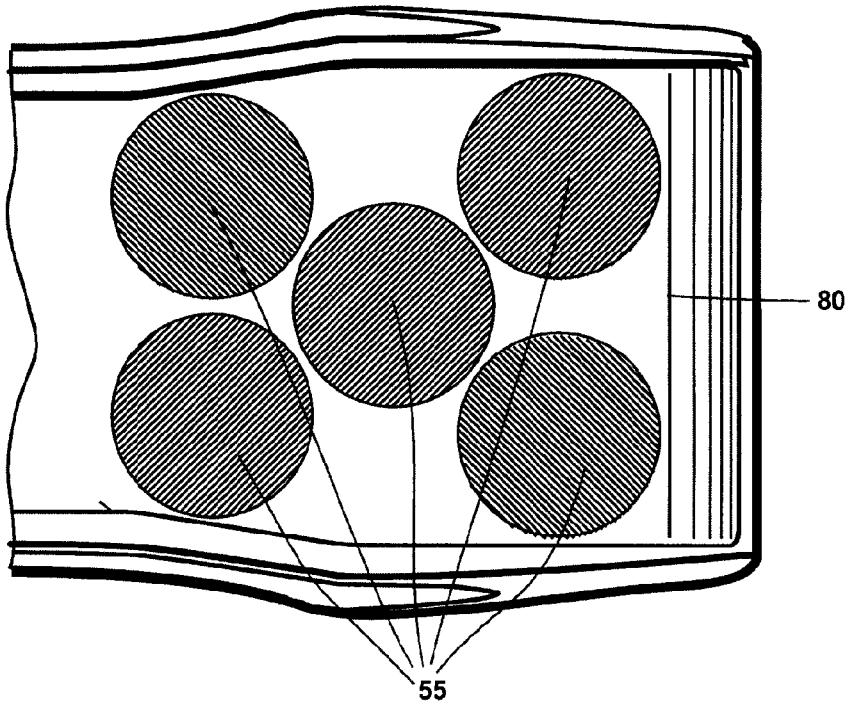
FIG. 13 is a top plan view of a seventh variant of the device illustrated in FIG. 1 with honing projections organized in islands that are spatially separated from one another.

FIG. 13 shows a non-limiting example of this alternative embodiment where the separation between islands is spatially oriented. With reference to this figure, it may be seen that circular islands of projections along the surface 26 occur within and are surrounded by the flat stropping pad that is normally associated with the second section 38. As a result, the cutting edges of a razor blade may be repeatedly honed and stropped as the razor travels along the surface 26 in this embodiment.

Figure 14:
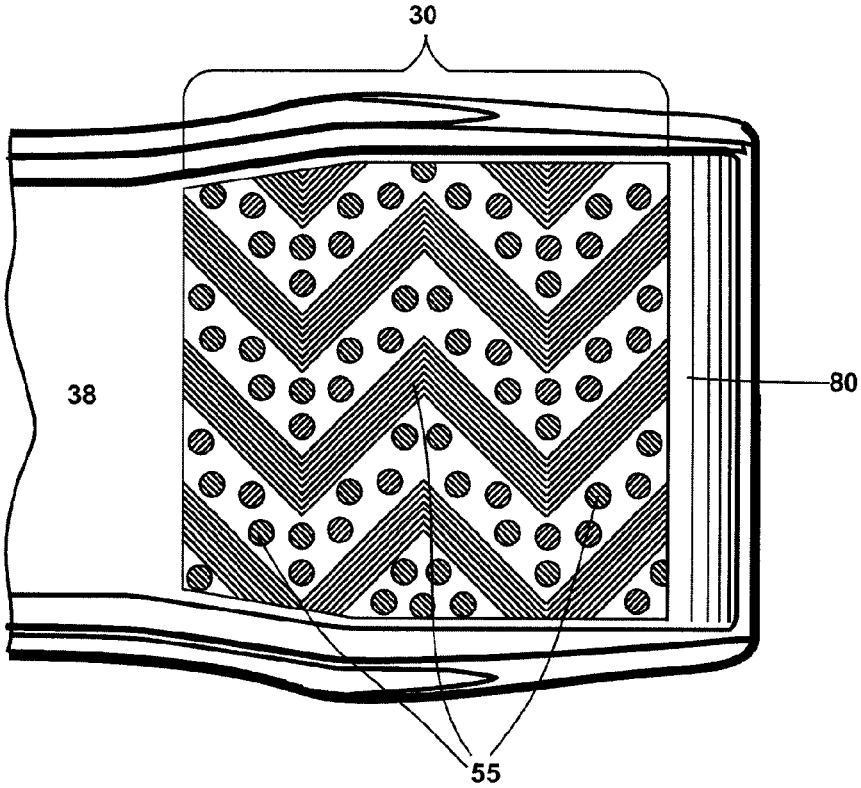
FIG. 14 is a top plan view of an eighth variant of the device illustrated in FIG. 1 with honing projections organized in islands, as well as in substantially straight lines.

FIG. 14 shows another non-limiting example of this alternative embodiment where the grouping is by the type of resilient projection. With reference to this figure, it may be seen that different types of resilient projections may be used in the honing projections 55 arranged along the surface 26. In this case, the honing projections 55 include generally adjacent areas that contain different types of projections. In this case, projections in certain areas follow generally straight lines that are arranged similarly to FIG. 7, while the other areas contain circular islands of projections arranged similarly to FIG. 13.

Usability Features of the Razor Blade Treatment/Restoration Device D'

The treatment/restoration device D' may include certain usability features, and in particular, features that apply and collect lubrication to or from the surface 26 and features that indicate the intended direction for a treatment stroke to a user.

4. Lubrication Application and Collection

During a restoration stroke, the head of a manual razor (and more particularly, its enclosed blade(s)) can be used to apply lubrication (e.g., soapy water or shaving cream) along the surface 26. The application of such lubrication assists the user when performing restoration strokes by reducing the friction between the razor blade(s) and the surface 26 and may also sterilize this surface if the lubrication includes germicides or similar sterilizing ingredients.

FIG. 1 shows a so-called "touchdown" area 80 that may be provided for the initial application of shaving cream or another lubricant to the surface of the central recess 24 prior to the restoration stroke(s) being performed. The provision of this area conveniently removes the need for a user to apply lubricant directly to the surface 26 and/or to the razor blades themselves.

The touchdown area 80 is generally located at (or is adjacent to) the terminal end of the lower section 12 that is adjacent to the first section 30. The area 80 may be integrally formed with the peripheral rims 20, 20', 28 and 28' such that it appears as a rounded lip or ramp that leads from a terminal edge of the device D' into the first section 30, such as illustrated in FIG. 1. Alternatively, the touchdown area 80 may occupy the area between the terminal edge of the device D' and the boundary of the first section 30, such that it appears as a substantially flat area that is adjacent to the honing projections 55. Regardless of the configuration of the touchdown area 80, when the razor head is placed in physical contact with this area, the slight pressure applied by the head onto the resilient material can transfer some of the lubrication to the surface of the encased razor blades.

As treatment strokes are performed by the user, it is likely that the motion of the razor (and especially the razor head) will cause some of the lubrication to be transported from the touchdown area 80, along the honing projections 55 in the first section 30, and then to the flat and smooth area of the stropping pad or surface contained within the second section 38.

The collection area 90 is comprised of a recess in which lubrication may collect and be temporarily stored. The general shape of the collection area 90 resembles that of a razor head, which is typically rectangular. However, the dimensions of this recess may be somewhat larger and deeper than that defined by a razor head in order to prevent any used and/or excess lubrication transferred from the razor head to the collection area 90 from subsequently contacting the razor blades and/or head.

2. Direction of Restoration Stroke

As mentioned previously, the dimensions of the central recess 24 in which the surface 26 is located is designed to accommodate the razor head for the restoration stroke that is performed by a user. More specifically, a typical treatment stroke starts with the razor head and blade(s) being first placed in physical contact with the touchdown area 80 that are adjacent to the honing projections 55 in the first section 30, and then the razor head and razor blades are moved laterally along these projections in the general direction of the second section 38 such that the blade(s) travel generally transversely to and come into sliding contact with the honing projections 55.

For convenience, a stroke indicator 40 may be provided to indicate the direction of the treatment stroke. The indicator 40 may include text, markings, symbols or other devices that show a user the direction in which their razor head should travel.

The stroke indicator 40 may be suitably integrated within the case and/or the surface 26, such as in the first section 30 or the second section 38. In a non-limiting example, the indicator 40 may appear as raised icons adjacent to (or integrated within) the touchdown zone 80. In this case, the icons for the stroke indicator 40 that provide an indication of the direction for a restoration stroke to a user may also indicate a substantially flat and empty area of the touchdown area 80 immediately adjacent to the first section 30 that could be used as the starting point for this stroke.

Figure 15:
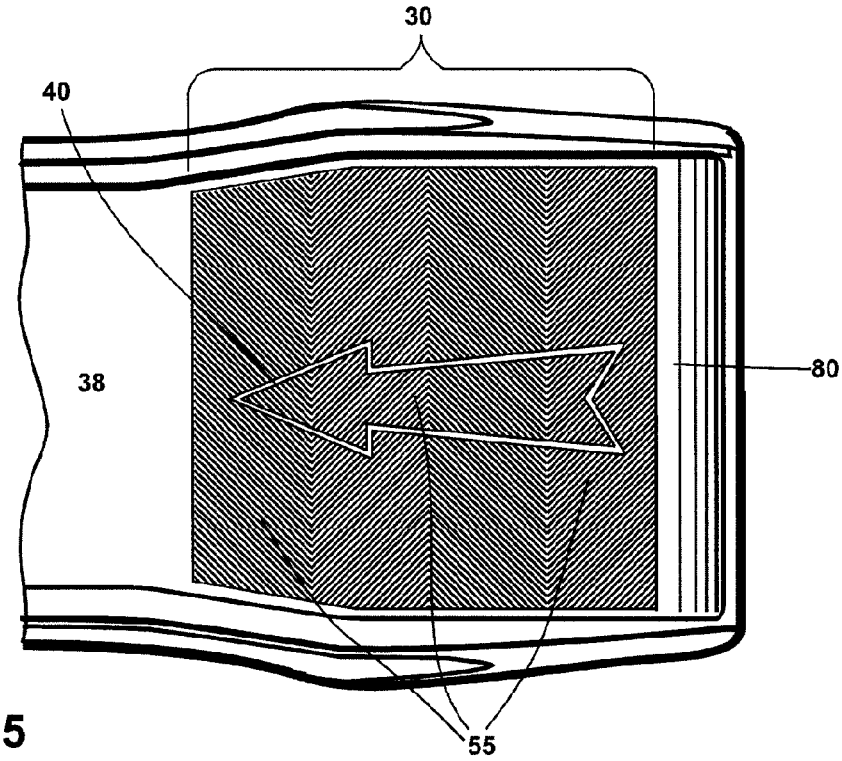
FIG. 15 is a top plan view of a ninth variant of the device illustrated in FIG. 1 with honing projections in substantially straight lines whereby the arrangement of a subset of honing projections produces an arrow.

Alternatively, FIG. 15 shows an arrow-shaped implementation of the stroke indicator 40 that is formed from an island of resilient projections in the honing projections 55 within the first section 30. This alternative implementation may be used if the size of the touchdown zone 80 is unable to incorporate the stroke indicator 40 in its entirety.

Method of Manufacture

The treatment/restoration device D' may be manufactured using an injection molding technique. In this case, a mold is first created for the treatment device D' containing the details for its various components, such as the surface 26, and more particularly, the honing projections 55. This mold is connected to an injection system that injects the resilient material into the mold. At the end of a certain injection period, the mold is opened and the treatment device D' is removed from the mold. It should be understood that this manufacturing technique may be used to produce the device D' comprised entirely of the resilient material.

Example of Use

With reference to FIGS. 16 to 22, the following non-limiting example is provided to show the general operation of the restoration device D' for restoring the blades of a non-electric shaving razor, and in this case, a manual shaving razor 100 with a razor head 110 containing two (2) razor blades, namely blades 115 and 117. Although the example presented here involves a non-electric shaving razor with two blades, this number of blades is chosen for illustrative purposes only and the same procedure could be performed with a shaving razor that contains a greater or lesser number of blades.

Figure 16:
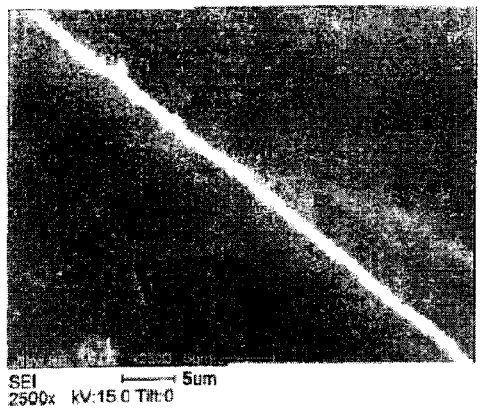
FIG. 16 is a micrograph of the edge a new razor blade found in a manual razor.

Assume that the shaving razor 100 was bought new and in this condition, the cutting edges of the blades 115 and 117 resemble that shown in the micrograph for FIG. 16, which was captured from the cutting edge of a razor blade by a scanning electron microscope at 2,500× magnification. This micrograph (as well as those in FIGS. 17 to 19) illustrates a fairly narrow zone along the cutting edge of the blade that is approximately three (3) microns in size that is in substantial contact with the skin during use and thus is mainly responsible for the perception of the closeness and comfort of the shave.

Figure 17:
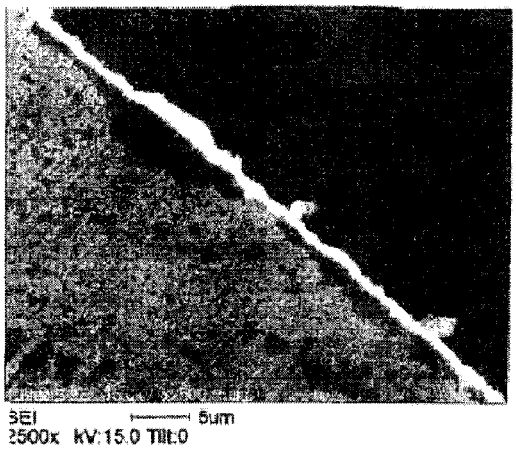
FIG. 17 is a micrograph of the razor blade illustrated in FIG. 16 after a period of use.

Assume that the razor 100 is used under normal shaving conditions over twelve (12) consecutive days and that the condition of these blade edges now resemble that shown in the micrograph for FIG. 17, which was captured from the same razor blade using the same equipment and at the same magnification level as that used for FIG. 16. From a comfort perspective, the razor 100 is unlikely to deliver what would be considered a satisfactory shave when the edges of the razor blades 115 and 117 are in this state.

The difference between the condition of the blade seen in FIGS. 16 and 17 over the twelve (12) days of use is likely due to the cutting edge of the razor blade being exposed to mechanical stresses that affect the very tip of its cutting edge. These stresses occur because, from the perspective of the cutting edge of the razor blade, the act of shaving involves the convergence of two distinct forces acting on its cutting edge, namely a "cutting force" and a "pulling force". The cutting force is the pushing force exerted by the cutting edges of the razor blades when these come into contact with, and subsequently penetrate the facial or body hairs in order to slice through them. In contrast, the pulling force comes from the resistance of the facial or body hair being shaved (and/or their associated roots or whiskers), which is ostensibly superior to the cutting force.

During shaving, these forces combine upon the cutting edge of the razor blade and create stresses that cause plastic and elastic deformations at its tip, which is very thin. In particular, as the narrow cutting edge(s) of the blade penetrate the facial or body hair, the repetitive shaving strokes gradually bend the tip of the cutting edge downwards toward the skin. As a result, the cutting edge develops microscopically misaligned inflections, which may increase over the repeated usage.

The net result of these developments is that the cutting edges become increasingly less effective at cutting hairs. While the distortions of the tip of the cutting edge are microscopic (indeed being so small that they can only be seen with a scanning electron microscope), their net effect at a macroscopic level is that a user perceives that the razor has become "dull", which describes a condition generally indicating that the razor blades have lost the ability to give a close and comfortable shave. To avoid or remedy such a situation, a user may treat the shaving razor with the razor blade treatment/restoration device D' to restore the sharpness of the blades using a procedure similar to the one described below.

Before the device D' is used to treat the blades in the razor 100, the user adds a small quantity of shaving cream, soapy water or other lubrication to the touchdown area 80 in order that this material may act as lubrication for the restoration strokes. Alternatively, the lubrication could be applied directly to the surface 26, including the touchdown area 80, the first section 30 and the second section 38.

Figure 20:
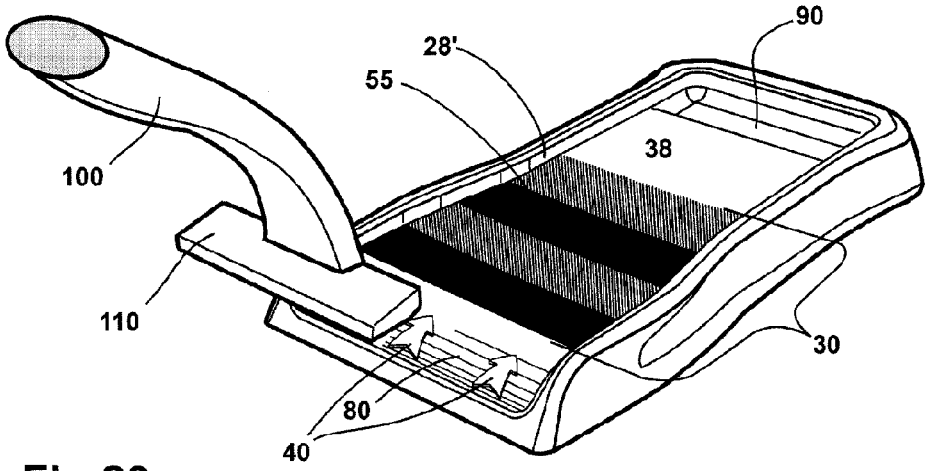
FIG. 20 is a perspective view of the razor blade treatment device illustrated in FIG. 1 with a razor in a first position for performing a razor blade restoring operation.

The user then orients the razor 100 in relation to the surface 26 in preparation for performing a restoration stroke. FIG. 20 shows the razor 100 in this first position, whereby the razor head 110 is oriented based on the touchdown area 80 and/or the guide or marking representing the restoration stroke indicator 40, which may be adjacent to and/or integrated within this area.

The user then sets the razor head 110 upon the touchdown area 80 that is located at the terminal end of the lower section 12 with the orientation as indicated by the stroke indicator 40. The application of the razor head 110 upon the touchdown area 80 is likely to bring the blades 115 and 117 into contact with the lubrication that was previously applied to this area of the surface 26, causing some of the lubrication to be transferred to these blades in turn. As a result, both the treatment device D' and the razor 100 are now prepared for the performance of a restoration stroke.

Figure 21:
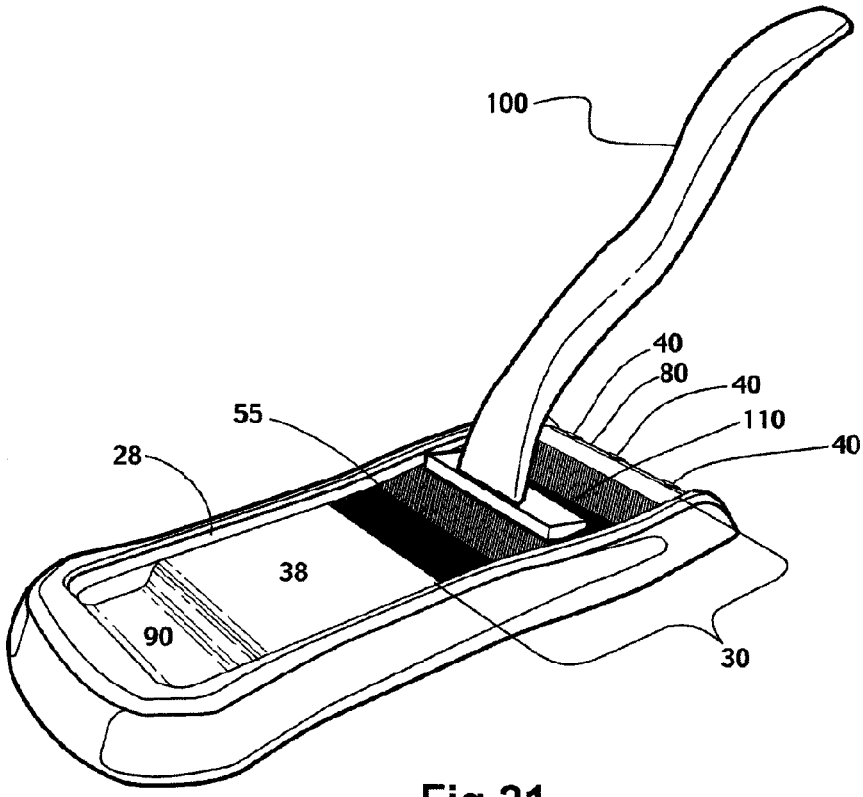
FIG. 21 is a perspective view of the razor blade treatment device illustrated in FIG. 1 with a razor in a second position for a razor blade restoring operation.

FIG. 21 shows the performance of a restoration stroke, which involves gently displacing the razor 100 in the indicated direction of the restoration stroke indicator 40 such that the blades 115 and 117 glide flat from their starting position on the first portion 30 of the surface 26 to an ending position on the second portion 38. During this process, the blades 115 and 117 come into initial contact with the honing projections 55 in the first section 30, which is followed by contact with the flat and smooth stropping pad or surface in the second section 38.

Figure 22:
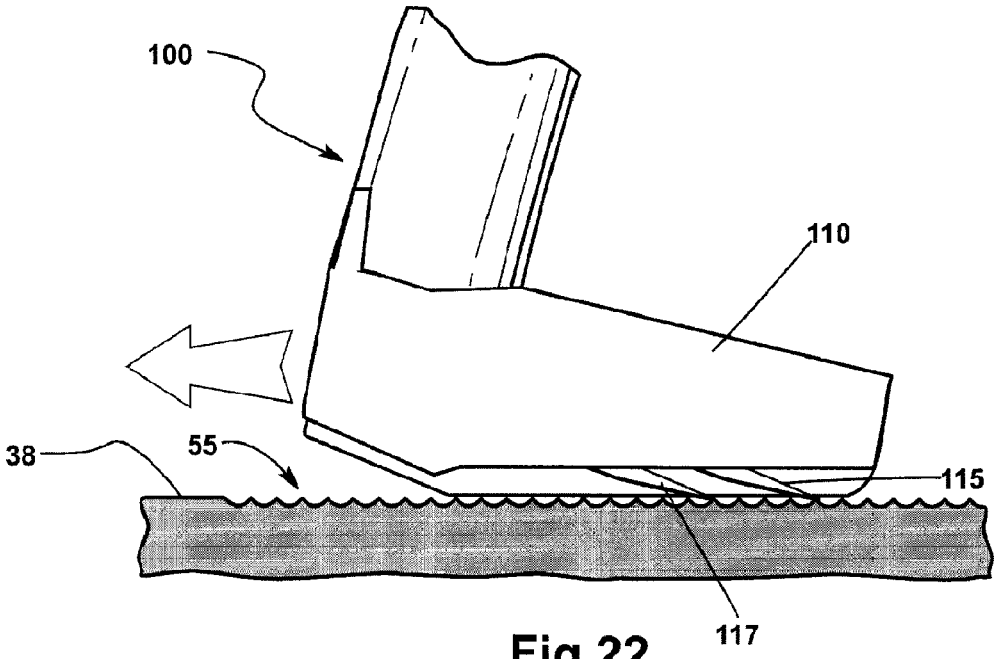
FIG. 22 is an enlarged cross-section view of the razor blade treatment device and razor illustrated in FIG. 21 during a razor blade restoring operation illustrating the interaction between the honing projections and the razor blade surface.

The slight sliding pressure applied to the razor 100 during the restoration stroke is transmitted to the razor head 110, which in turn causes the cutting edges of the razor blades 115 and 117 to make sliding contact with the honing projections 55 in the first section 30. FIG. 22 shows a closer view of a cross-section of the razor 100 in this position, in particular showing how the blades 115 and 117 can make sliding contact with the resilient projections in 55 in the first section 30. This results in the generation of a surface area of discontinuous contact created between the cutting edges of these blades and the tip portions 34 of these certain projections. Using FIG. 21 as a reference, this position would place the cutting plane of the razor blades 115 and 117 substantially co-planar with the honing projections within the first portion 36*a*.

As the razor blades 115 and 117 slide along the surface 26 during the restoration stroke, which may be assisted by the actions of the aforementioned lubrication, the honing projections 55 act as many individual tiny honing rods on these blades, each applying slight pressure on the razor blades (i.e., to the cutting edges of the blades 115 and 117) in order to restore the alignment of those portions of the tip that have become distorted through use.

During this portion of the restoration stroke, the sliding contact between the blades 115 and 117 and the honing projections 55 act to hone the entirety of the cutting edges of these razor blades. In particular, the orientation and arrangement of the projections 55 are generally transverse to the direction of travel of the razor 100. As a result, the point or area of contact between the blades 115 and 117 and each individual resilient projection are swiped lengthwise along the cutting edge, causing different portions of each resilient projection in the projections 55 to engage different longitudinal areas of the cutting edge of the razor blades 115 and 117 during the stroke. For example, a contact segment between the blade 115 and a certain projection may start at the lateral extremity of this blade and then travel towards the opposite side of the blade as it moves along the projection during the restoration stroke.

Using FIGS. 20 and 21 as a reference, it may also be seen that because the honing projections 55 in the first section 30 include straight segments with multiple orientations (namely those at a +45° angle to the direction of travel of the razor 100 and those at a −45° angle to this direction), the restoration stroke also ensures that the blades 115 and 117 are honed from at least two directions. For example, a first portion of the cutting edge of the blade 115 may come into sliding contact and be honed by a first part of the resilient projection that is oriented at a +45° angle to the direction of travel of the razor 100, while a second portion of this blade comes into sliding contact with a second portion of the resilient projection that is oriented at a −45° angle.

Because the orientation of the honing projections 55 switch between these two orientations at various points along the first section 30, it is likely that the first and second portions of the blade 115 will be honed from both these two directions.

When the razor blades 115 and 117 reach the stropping pad or surface within the second section 38, this flat and smooth area acts as a strop, which further helps to realign the blade tip. The net effect of the honing action performed by the honing projections 55 and the stropping action performed by the flat and smooth area of the second section 38 during the restoration stroke is to substantially realign the cutting edge of the blades 115 and 117, further details of which are provided below.

The restoration stroke concludes when the razor 100, and more particularly the head 110, reaches the collection area 90. When the head 110 reaches this area, gravity causes any excess lubrication that came into contact with the razor blades 115 and 117 and was driven forward by the restoration stroke to drain off of these blades and flow into this recess.

At the conclusion of the restoration stroke, the razor 100 is returned to its original orientation and position in relation to the treatment device D' (i.e., at the touchdown area 80) and the restoration stroke may then be repeated as necessary to restore the sharpness of the razor blades 115 and 117 to the user's satisfaction. Once the user is satisfied with the restored sharpness of the blades 115 and 117, he or she may wash the device D' in order to remove any lubrication and/or any particulate matter that has collected on the surface 26, as well as in the collection area 90.

The resulting treatment of the razor blades is based on the realignment of the cutting edges of the razor blades, rather than on an abrading action or simple stropping that may be used in prior art devices. The treatment operation described above substantially restores the original shape of the cutting edges of the razor blades that had become increasingly elongated and irregularly bent during the course of normal shaving, largely by re-aligning of the tip of the cutting edges back to their original shape and sharpness. While honing can be understood to mean an abrasive polishing or sharpening of a blade by moving the cutting edge against a hone (including in the direction of the cutting edge), a honing rod or honing steel is used against a blade essentially away from the direction of the cutting edge in a manner that may not remove material from the blade and improves the condition of the cutting edge.

Figure 18:
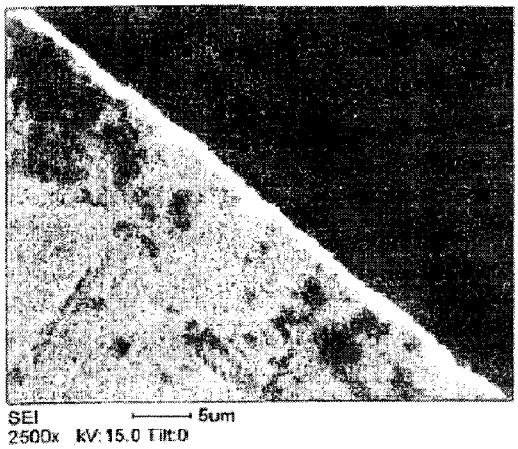
FIG. 18 is a micrograph of the razor blade illustrated in FIG. 17 after being treated using the razor blade treatment device illustrated in FIG. 1.
Figure 19:
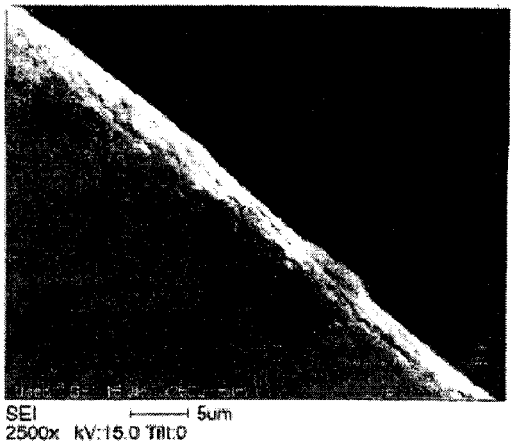
FIG. 19 is a micrograph of the razor blade illustrated in FIG. 18 after an extended period of use and after being repeatedly treated using the razor blade treatment device illustrated in FIG. 1.

FIGS. 18 and 19 show micrographs illustrating the effects of a treatment operation similar to that described above on the cutting edge of the same razor blade and using the same equipment and under the same magnification as was used to capture the micrographs for FIG. 16 and FIG. 17. In particular, the cutting edge of the razor blade shown in FIG. 18 is one that has been in daily use for six (6) months and that has been periodically treated on the treatment/restoration device D', but now requires re-treatment. It will be appreciated that the condition of the cutting edge is better than the condition of the cutting edge shown in FIG. 17 where the razor blade was only used a dozen times but had never been treated on the device D'. In contrast, FIG. 19 shows the cutting edge of the razor blade immediately after the razor has been treated on the device D'. It will be appreciated that the tip of the cutting edge of the blade is in a condition that is very similar to a new cutting edge that has never been used (i.e., the edge of the blade shown in FIG. 16).

With use, the condition of the edges of the blades 115 and 117 will likely gradually return to a condition similar to that illustrated in FIG. 17 or 18, whereby the cutting edges fall out of alignment and the tips of the cutting edges becomes elongated and bent due to normal shaving operations. During this period, the treatment/restoration device D' may be regularly used on a periodic basis (e.g., whenever the user senses that the razor 100 is dull) in order to restore the razor blades by repeating the general procedure described above.

Advantageously, regular use of the restoration device D' on a periodic basis may allow the operational lifespan of a non-electric shaving razor to be otherwise extended past the expected lifespan for such a device. This may represent considerable cost-savings to a user who would otherwise need to regularly replace non-electric shaving razors whose blades are delivering an unsatisfactory shave. In addition, the ability to extend the lifespan of so-called "disposable" nonelectric razors would reduce the environmental impact from the millions of such devices (and their associated packaging material) that would otherwise be disposed of in landfills or other waste-collection facilities.

Furthermore, the use of the restoration device D' may also advantageously provide considerable convenience to certain users who may spend extended periods of time travelling outside of urban areas and/or for whom weight and space is a primary consideration, such as hikers, mountaineers, soldiers or field researchers, among others. In these cases, the ability to regularly treat their manual shaving razor using a razor blade restoration device, such as the device D', could save weight and space that would otherwise be required for a plurality of such instruments due to their short individual life spans.

Although the above description and example of the treatment/restoration device D' has been presented in the context of treating blades for the purpose of restoring their cutting properties, other embodiments are possible. One such alternative embodiment could be used to treat the blades of a non-electric shaving razor during the manufacturing stage, in order to further improve their cutting properties prior to the razor's first use.

In this alternative embodiment, the device D' contains a surface similar to the surface 26, which contains a first section with honing projections similar to the section 30 and the honing projections 55, and a second section with a stropping pad or surface similar to the section 38. However, in this alternative embodiment, the sliding motion between the razor blade and the first and second sections of this surface is performed using automated and/or mechanical means in a factory or manufacturing plant, rather than being manually performed by a user as described above.

In one non-limiting example, the resilient material containing the features of the first and/or second sections may be formed along the exterior (i.e., blade-facing) surface of a rotating drum. The axis of rotation for this drum is perpendicular to the direction of travel of the razor blades along a conveyor belt, which is analogous to the orientation of the surface 26 to the blades 115 and 117 in the example above. As a result, when the cutting edge of a razor blade travelling along the conveyor belt comes into contact with the surface of the rotating drum (and in particular the honing projections within the first section of this surface), its cutting edge is initially honed by the honing projections in the first section of the drum's surface and then stropped by the complementary stropping surface in the second section of the drum's surface.

In another non-limiting example, the surface of an endless belt or track (such as a conveyor belt along which the blades travel during the manufacture of the non-electric razor) could be formed from the resilient material in which the features of the first and second sections described above are found. Razor blades travelling along this belt or track would come into contact with the honing projections in the first section and the stropping pad or surface in the second section during their transport.

Furthermore, if the surface of the rotating drum or conveyor belt in the examples above is comprised of alternating first and second sections, a single razor blade may encounter multiple instances of honing projections and stropping pads along this surface multiple times during a single restoration stroke.

The surface 26 of the sharpening pad 24 may be made only of a smooth section, such as the second section 38 and thus without the textured/grated first section 30, whereby the sharpening surface is used only as a lubricated strop.

Although the present invention has been described in considerable detail with reference to certain preferred embodiments thereof, variations and refinements are possible without departing from the spirit of the invention. Therefore, the scope of the invention should be limited only by the appended claims and their equivalents.

The invention claimed is:

1. A device for treating a blade of a manual razor, the blade having a cutting edge, the device comprising:

a. a treatment surface made of resilient, non abrading material for interacting with the cutting edge when the blade is in sliding contact with the treatment surface, the treatment surface including a plurality of resilient projections having a base portion and a tip portion;

b. the resilient projections defining a discontinuous contact surface with the blade during the sliding contact.

2. A device as defined in claim 1, wherein the treatment surface has a resiliency of less than 70 according to the Shore A or 00 scale in the ASTM D2240 standard.

3. A device as defined in claim 1, wherein the treatment surface has a resiliency of less than 50 according to the Shore A or 00 scale in the ASTM D2240 standard.

4. A device as defined in claim 1, wherein the treatment surface has a resiliency of less than 30 according to the Shore A or 00 scale in the ASTM D2240 standard.

5. A device as defined in claim 1, wherein the plurality of resilient projections include a set of resilient projections, each of the resilient projections in the set having a generally linear configuration.

6. A device as defined in claim 5, wherein each of the resilient projections having a generally linear configuration includes at least one straight line segment.

7. A device as defined in claim 6, wherein each of the resilient projections having a generally linear configuration includes at least two adjacent straight line segments joined at angle.

8. A device as defined in claim 5, wherein each of the resilient projection having a generally linear configuration including at least one curved line segment.

9. A device as defined in claim 5, wherein the treatment surface includes an area over which the resilient projections having a generally linear configuration are parallel.

10. A device as defined in claim 5, wherein the treatment surface includes an area over which the resilient projections having a generally linear configuration are uniformly spaced from one another.

11. A device as defined in claim 5, wherein the treatment surface includes an area over which the resilient projections having a generally linear configuration are non-uniformly spaced from one another.

12. A device as defined in claim 1, wherein the resilient projections have a height of less than 1 mm.

13. A device as defined in claim 1, wherein the resilient projections have a height of less than 0.7 mm.

14. A device as defined in claim 1, wherein the resilient projections have a height of less than 0.5 mm.

15. A device as defined in claim 1, wherein the resilient projections have a height of less than 0.3 mm.

16. A device as defined in claim 1, wherein the resilient projections have a height of less than 0.2 mm.

17. A device as defined in claim 1, wherein said treatment surface has an edge direction and a direction transverse to said edge direction, the resilient projections are arranged on the treatment surface to have in a length of 1 millimeter in said transverse direction a number of resilient projections in the range from 1 to 5.

18. A device as defined in claim 1, wherein said treatment surface has an edge direction and a direction transverse to said edge direction, the resilient projections are arranged on the treatment surface to have in a length of 1 millimeter in said transverse direction a number of resilient projections in the range from 2 to 4.

19. A device as defined in claim 1, wherein said treatment surface has an edge direction and a direction transverse to said edge direction, wherein the resilient projections are arranged on the treatment surface to have in a length of 1 millimeter in said transverse direction with 3 resilient projections.

20. A device as defined in claim 1, wherein the treatment surface includes an area free of the resilient projections.

21. A device as defining in claim 20, wherein the area free of the resilient projections is smooth surfaced.

22. A device as defined in claim 21, wherein the area free of the resilient projections and the resilient projections are integrally formed.

23. A device as defined in claim 1, wherein said resilient material is a polymer material.

24. A device as defined in claim 1, wherein said resilient material is selected from the group consisting of Acrylic rubber, Butadine rubber, Butyl rubber, Isoprene rubber, Nitrile rubber, Polysulfide rubber, Silicone rubber, and Styrene Butadine rubber.

25. A device as defined in claim 1, wherein said resilient material is a thermoplastic elastomeric rubber.

26. A method for treating a blade of a manual razor, the blade having a cutting edge, the method comprising:

a. providing a treatment surface including a plurality of resilient projections with a base and a tip portion;

b. moving the blade and the treatment surface one with relation to the other such that the cutting edge is in a sliding contact with the resilient projections;

c. pressing the manual razor and the treatment surface one against the other during the sliding contact such that the cutting edge compresses the resilient projections and defines a discontinuous contact surface therewith so as to provide a treatment of the cutting edge by substantially restoring an original shape of the cutting edge rather than by an abrading action.

27. A method as defined in claim 26, including adding a lubricant on the treatment surface.

28. A method as defined in claim 26, wherein the resilient projections include resilient projections having a generally linear configuration.

29. A method as defined in claim 28, including arranging the resilient projections having a generally linear configuration such that during the sliding movement, segments of the resilient projections having a linear configuration extend generally obliquely with relation to the cutting edge of the blade.

30. A method as defined in claim 28, including arranging the resilient projections having a generally linear configuration such that during the sliding movement segments of the resilient projections having a linear configuration swipe lengthwise the cutting edge of the blade.

31. A method as defined in claim 26, including arranging the resilient projections such that during the sliding movement different segments of a given one of said resilient projections engage different longitudinal areas of the cutting edge.

32. A method as defined in claim 26 wherein the treatment surface further comprises a substantially plane surface area free of the resilient projections such that during the sliding movement the cutting edge is successively in a sliding contact with the resilient projections and the substantially plane surface area.

33. A method as defined in claim 26, wherein said treatment surface is held stationary, and said moving comprises moving said razor on said treatment surface.

34. A method as defined in claim 26, wherein said razor is held stationary, and said moving comprises moving said treatment surface.

35. A method as defined in claim 34, wherein said treatment surface is a drum that rotates while said razor is held fixed with respect to said drum.

36. A method of manufacturing a manual razor having a blade, the method comprising treating the blade in accordance with claim 26.

37. A method as defined in claim 26, wherein said resilient projections are made of polymer material.

38. A method as defined in claim 26, wherein said resilient projections are made of a material selected from the group consisting of Acrylic rubber, Butadine rubber, Butyl rubber, Isoprene rubber, Nitrile rubber, Polysulfide rubber, Silicone rubber, and Styrene Butadine rubber.

39. A method as defined in claim 26, wherein said resilient projections are made of thermoplastic elastomeric rubber.

* * * * *